United States Patent [19]

Brooks

[11] 4,420,043

[45] Dec. 13, 1983

[54] VALVING APPARATUS FOR SELECTIVELY SEALING AN ANNULUS DEFINED BETWEEN A WORK STRING AND THE BORE OF AN ELEMENT OF A PRODUCTION STRING OF A SUBTERRANEAN WELL

[75] Inventor: Robert T. Brooks, Kingwood, Tex.

[73] Assignee: Baker International Corporation, Orange, Calif.

[21] Appl. No.: 277,572

[22] Filed: Jun. 25, 1981

[51] Int. Cl.[3] ..... E21B 34/10

[52] U.S. Cl. ..... 166/319; 166/321; 166/334

[58] Field of Search ..... 166/319, 321–332, 166/334, 374, 375, 386, 387, 187, 322, 323

[56] References Cited

U.S. PATENT DOCUMENTS

| | | | |
|---|---|---|---|
| 3,338,310 | 8/1967 | McGill | 166/187 |
| 3,367,422 | 2/1968 | Sims | 166/187 |
| 4,270,610 | 6/1981 | Barrington | 166/319 X |

*Primary Examiner*—Stephen J. Novosad
*Assistant Examiner*—Thuy M. Bui
*Attorney, Agent, or Firm*—Norvell & Associates

[57] ABSTRACT

The disclosure provides a valve for an annulus defined between a tubular work string or other conduit and a surrounding annular portion of an operative element disposed on production string, such as a safety valve. The annulus valve comprises an annular valve body, which may comprise an elastomeric mass, which is urged by resilient means into sealing engagement with the exterior of the tubular work string and is shiftable out of such sealing engagement, such as by an annular piston which is responsive to control fluid pressure. The same control fluid pressure may be utilized to operate the safety valve to its open position.

16 Claims, 7 Drawing Figures

VALVING APPARATUS FOR SELECTIVELY SEALING AN ANNULUS DEFINED BETWEEN A WORK STRING AND THE BORE OF AN ELEMENT OF A PRODUCTION STRING OF A SUBTERRANEAN WELL

BACKGROUND OF THE INVENTION

1. Field of the Invention:

This invention relates to a valving apparatus for use in a subterranean well, and particularly an apparatus for selectively sealing an annulus defined between the exterior of a work string and the interior of an operative element contained in a production string, such as a safety valve.

2. Description of the Prior Art:

Prior to placing any well into production, there are a number of operative elements incorporated in the production string. For example, one or more safety valves may be located at different depths along the production string. It often happens that chemical treatment, flushing or similar operations must be accomplished on the production formation, the gravel pack or the screen. Many such operations are accomplished by inserting into the bore of the production string a length of continuous tubing sometimes called "macaroni" tubing or lengths of sand washing tubing which will conduct flushing or treating fluids to the area of the well requiring attention. Such tubing may pass through one or more safety valves incorporated in the production string, and the presence of such tubing effectively prevents the closing of the safety valve until the tubing is withdrawn.

As is well known to those skilled in the art, and has been recognized by various governmental safety regulations governing the treatment of repair of wells, if the safety valve is to be blocked from closing by the passage of any work string therethrough, it is commonly required that the well be killed before the treatment operation can proceed. This is obviously a time consuming and expensive operation.

SUMMARY OF THE INVENTION

This invention provides an apparatus which will effectively seal the annulus defined between a tubular work string and the interior of the housing of a safety valve or similar operative element of a subterranean well upon the occurrence of any incident that would normally require the closing of the safety valve. While the safety valve cannot be closed, the annulus between the work string and the interior bore of the safety valve or similar element is effectively sealed, and the upward fluid passage through the work string may be effectively controlled by other valving devices located at the well head or at the bottom of the work string. Most important, the annulus valving apparatus provided by this invention remains in the well and may be repeatedly used to sealingly engage the exterior of any inserted tubular work string.

The annulus valve is defined by a valve head, such as an annular mass of elastomeric material which, in its uncompressed position, freely surrounds any tubular work string and permits the ready passage of the work string through its bore and, of course, the ready passage of fluid through the annulus defined between the work string and the interior bore of the operative element, such as a safety valve. A bias means is provided which would normally impose an axial compressive force on the annular elastomeric mass urging such mass radially inwardly to effect a sealing engagement with the valve seat, which is the outer wall of the tubular work string, and the inner wall of the surrounding housing of a safety valve. The bias means is, however, opposed by an annular piston which is supplied with a control fluid pressure from the well head. Such control fluid pressure may conveniently be the same fluid pressure as is employed to effect the actuation of the safety valve to an open position. Upon any significant reduction or the loss of the control fluid pressure, the bias means effects an axial compression of the annular elastomeric mass and produces an effective seal of the annulus between the work string and the interior bore of the safety valve housing. The well is thus effectively controlled.

The annulus seal may be immediately released by the reapplication of control fluid pressure to the piston which effects a retraction of the force of the bias means from the annular elastomeric mass, and the elastic memory of such mass permits it to retract radially outwardly sufficiently to open the annulus for fluid flow and/or withdrawal of the tubular work string.

BRIEF DESCRIPTION OF THE DRAWINGS

FIGS. 1B and 1C being respectively vertical continuations of FIGS. 1A AND 1B.

FIG. 2B being a vertical continuation of FIG. 2A.

DESCRIPTION OF THE PREFERRED EMBODIMENTS

Figure 1A:
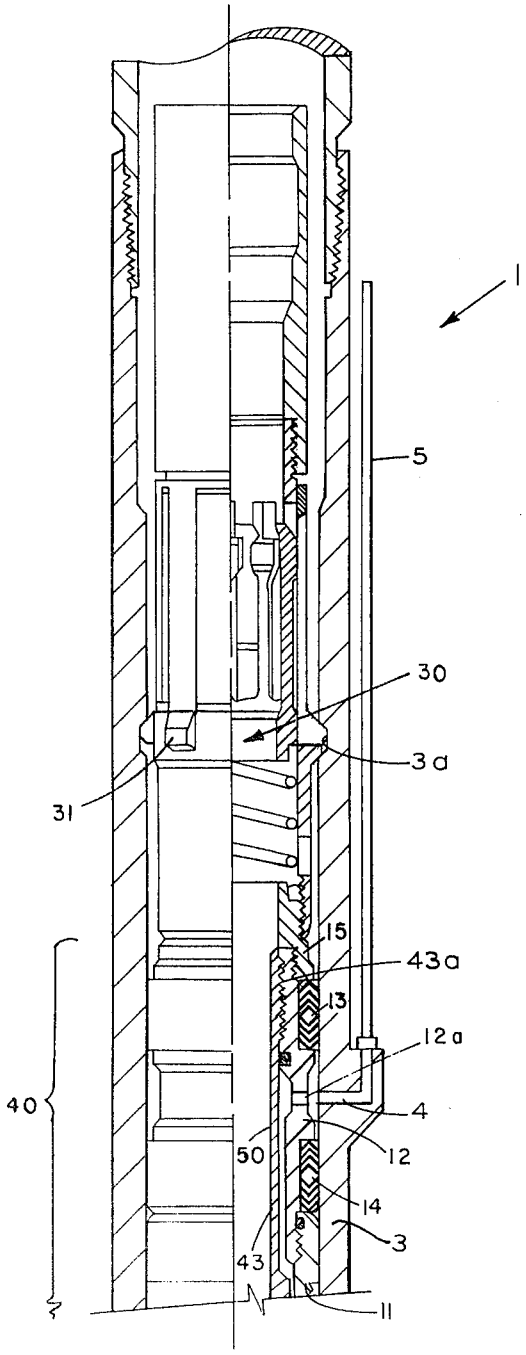
FIGS. 1A, 1B and 1C collectively represent a vertical sectional view of a safety valve for a subterranean well incorporating an annulus valve constructed in accordance with this invention.

While an annulus valve embodying this invention may be incorporated in any operative element of a production string for a subterranean well, it is preferably incorporated in an element to which a control fluid pressure is supplied by a separate conduit from the top of the well. Thus, in FIGS. 1A–1C, there is shown a safety valve 1 incorporating a rotatable ball valve 2 which is shifted to an open position through the application of a control fluid pressure to an actuating piston 25 which effects the rotation of the ball valve 2 to an open position against the bias of compression springs **27*a* and 27*b* which normally urges the ball valve to a closed position, as specifically illustrated in FIG. 1C. The safety valve 1 includes an upwardly extending outer housing 10 within which the annulus valve mechanisms 40 is mounted. The upper portion of ball valve housing 10 is threadably engaged at its top end to a connector sleeve 11 which is threadably engaged at its top end to a seal mounting sleeve 12 which carries a pair of axially spaced chevron seal assemblies 13 and 14. Seal assemblies 13 and 14 sealingly engage the bore of a seal nipple 3 in conventional fashion, the nipple 3 being secured to a production string thereabove. The upper end of the seal mounting sleeve 12 is in turn threadably secured to a connecting sub 15, which in turn is threadably secured to the lower end of a conventional locking mechanism 30 having outwardly projecting locking collets 31 engageable in a conventional seating nipple 3a provided in the seal nipple 3. Locking mechanism 30** may comprise any one of several well known mechanisms, for example the locking mechanism described and illustrated in copending application Ser. No. 3,154 filed Jan. 15, 1979 and assigned to the Assignee of this application.

Figure 1B:
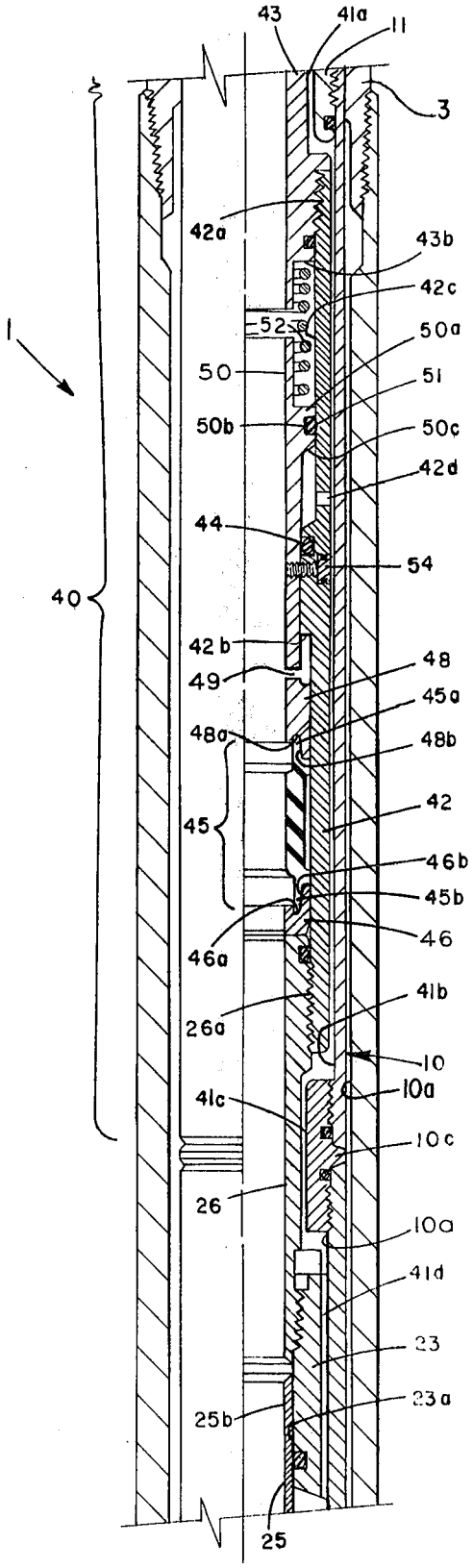
Figure 1C:
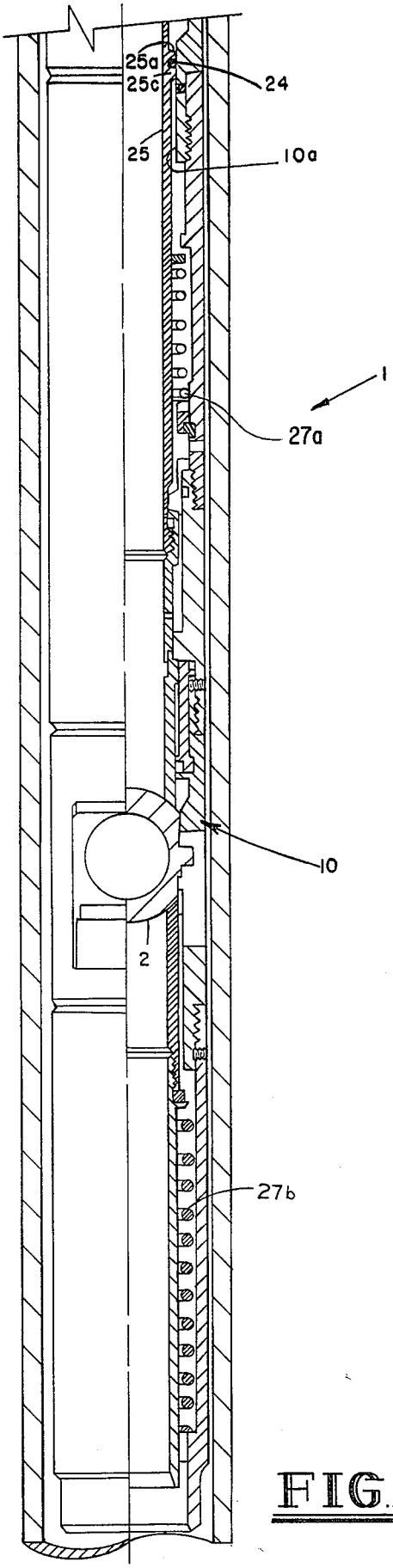
Figure 2A:
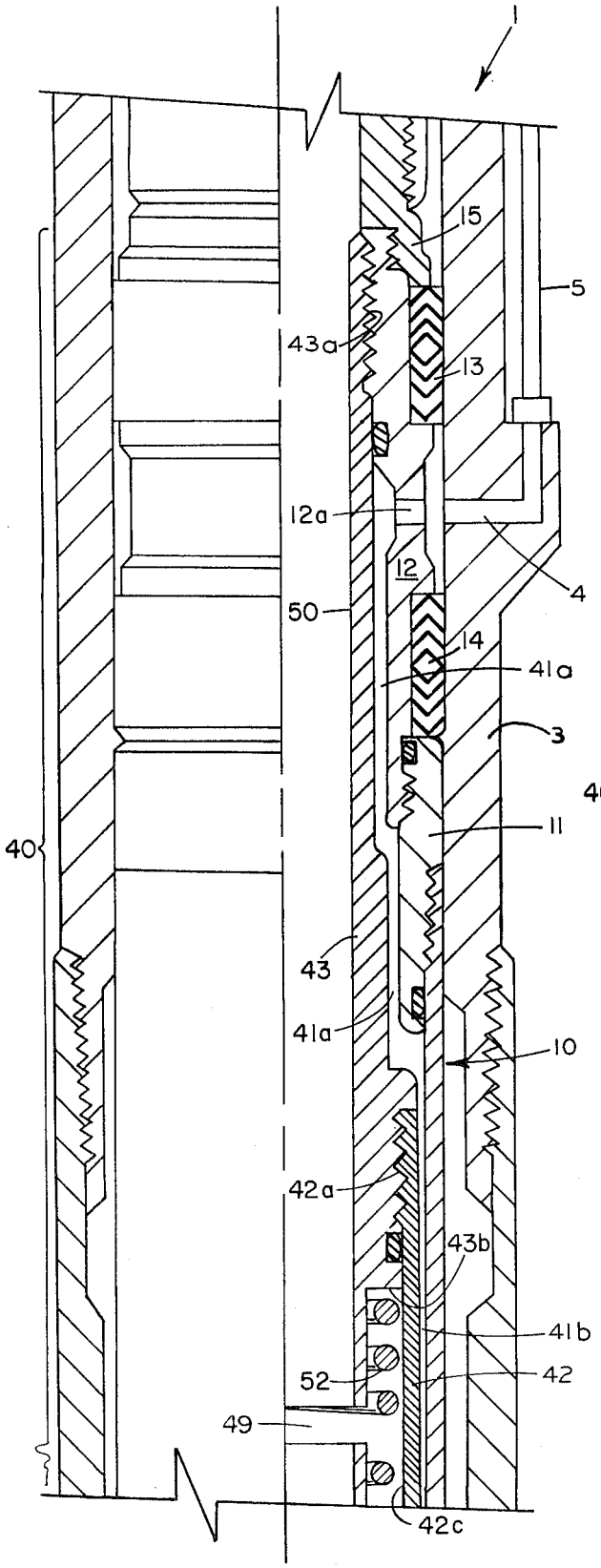
FIGS. 2A AND 2B constitute enlarged scale vertical sectional views of that portion of the safety valve shown in FIG. 1 which includes the annulus valve constructed in accordance with this invention, with the annulus valve shown in its open or non-sealing position.
Figure 2B:
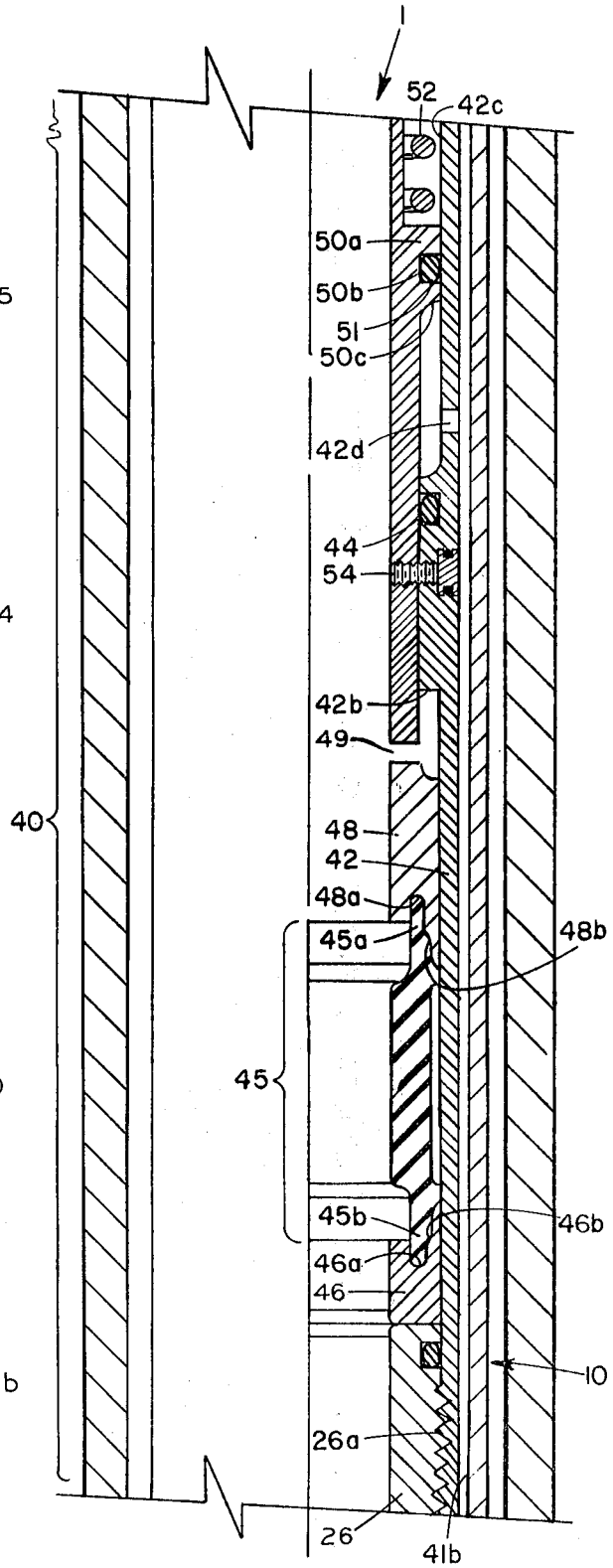

The seal mounting sleeve 12 is additionally provided with a radial port 12a which is connected in conventional fashion to a conduit 4 traversing the wall of the production string and connected by tubing 5 to a pressured fluid source at the top of the well. Thus a control fluid pressure may be supplied to the interior of the housing 10 and passes downwardly within such housing through an interconnected series of annular fluid passages until the control fluid pressure impinges upon an upwardly facing annular surface 25a of the annular piston element 25 which provides the opening force for the ball 2 of safety valve 1. All of the structure below the actuating piston 25 of the safety valve 1 is conventional, being manufactured and sold by Baker Packers Division, Baker International Corporation, of Houston, Tex. as the "Super Series E" safety valve that is described and illustrated on page 775 of the 1980 Completion Systems Catalog published by Baker Packers Division. Accordingly, no further description of the safety valve portion of the apparatus shown in FIGS. 1A–1C is deemed to be necessary.

The upper end 25b of the annular safety valve piston 25 is slidably and sealingly engaged with the interior bore 23a of a guide sleeve 23. The effective area of the annular safety valve piston 25 is defined by a projecting shoulder 25c which defines an annular recess mounting a seal 24 which has sliding engagement with an interior bore surface 10a of the safety valve housing 10. The piston guide sleeve 23 has a series of radially disposed longitudinal holes through it and thus defines the lowermost portion 41d of an annular fluid passage extending from port 12a into communication with the upwardly facing surface 25a of the piston 25.

The piston guide sleeve 23 is threadably secured at its top end to a connecting sleeve 26 which has external threads 26a engaging internal threads provided on the lower end of an inner housing 42 for the annulus valve mechanism 40. The inner housing 42 extends upwardly the full length of the annulus valve apparatus 40 and is threadably engaged by internal threads 42a on its upper end to the lower end of a sleeve 43 which has a threaded engagement 43a at its top end with the aforementioned seal assembly sleeve 12. The external diameter of sleeve 43 is always smaller than the internal diameter of the adjacent portions of the seal assembly sleeve 12 and the adjacent portions of the connector sleeve 11, thus defining an annular passage 41a extending downwardly from the inlet port 12a to communicate with an annular passage 41b defined between the outer surface of the inner housing 42 and the inner surface 10a of the safety valve housing 10. The annular fluid passage 41b in turn communicates with an annular fluid passage 41c defined between a connector sleeve 10c of the outer housing 10 and the inner connector sleeve 26. Lastly, this annular fluid conduit 41c communicates with the radially disposed longitudinal passages 41d through the piston guide sleeve 23.

An annular valving or sealing element 45 is mounted within the inner housing 42 of the annulus valve assembly 40. Such valve or sealing element 45 may conveniently comprise an annular mass of elastomeric material of generally elongated configuration, and particularly having at its top and bottom ends reduced thickness annular projections 45a and 45b, respectively. Projection 45b fits within a complimentary slot 46a defined in an annular cam element 46 which is fixed in position by resting against the top surface of the connector sleeve 26. The one wall 46b of the slot 46a is inclined outwardly so as to impart a radially inward bias to the elastomeric mass when such mass is compressed against such surface. Similarly, the upper end 45a of the elastomeric mass 45 is snugly engaged in a slot 48a provided in the lower end of an annular anvil type cam element 48 which is slidably mounted for axial movements within the internal bore of the inner housing 42. The one surface 48b of slot 48a is angularly inclined so as to impart a radially inward thrust to the elastomeric mass 45 whenever a compressive force is applied thereto by the annular anvil cam element 48.

Anvil cam element 48 is actuated by downward movement of an annular piston 50, which has a lower portion slidably cooperating with the internal surface of an internal projection 42b of the inner housing 42, and a radially enlarged shoulder 50a defining a recess 50b for receiving a seal 51 which slidably and sealingly engages the internal wall portion 42c of the inner housing 42. A seal 44 is provided in the internally projecting portion 42b and slidably cooperates with the lower end of the annular piston 50. A seal 51 in piston shoulder 50a cooperates with bore 42c of inner housing 42.

A radial port 42d is provided in the wall of the inner housing 42 in communication with the annular fluid passage 41b. Thus, whenever a control fluid pressure is supplied to the main inlet port 12a, such pressure will also be applied to the downwardly facing surface 50c formed on the piston shoulder 50a and will urge the piston 50 in an upward direction. The same fluid pressure is concurrently supplied to piston 25 of safety valve 1.

Upward movement of piston 50 is opposed by a compression spring 52 which has its bottom end engaging the top surface of the piston shoulder 50a and its top end abutting a shoulder 43b provided on the mounting sleeve 43.

During the run in of the safety valve 1 and the associated annulus valving apparatus, the piston 50 is maintained in an inoperable position, with the spring 52 fully compressed, by a shear pin 54 which traverses the adjacent wall portions of piston 50 and internally projecting portion 42b of the inner housing 42. The shear pin 54 can be sheared after the insertion of the entire assemblage into the production string and the setting of lock mechanism 30, by increasing the control fluid pressure to the level required to effect the shearing of shear pin 54.

Thereafter, the annulus valve 40 will be maintained in its non-sealing or open position only so long as a control fluid pressure is supplied to the annular actuating piston 50 sufficient to keep the spring 52 compressed and thus avoid the imposition of compressive forces on the annular elastomeric seal member 45. The same pressure will, of course, maintain the ball 2 of safety valve 1 in its open position in accordance with conventional procedures.

At any time that conditions require the closing of the safety valve 1 and the annulus valve 40, it is merely necessary to reduce the control fluid pressure to an extent that the spring 52 can shift the piston 50 downwardly. Such downward movement of the piston, effects its engagement with the annular anvil cam 48 and imposes a compressive force on the annular elastomeric seal 45, causing it to compress and deform radially inwardly and thus effect a sealing engagement with the external periphery of a tubular work string 60 (FIGS. 3A and 3B) which may have been inserted within the production string. The ball 2 of safety valve 1 will, of course, only close to the extent permitted by the inserted tubular work string, and hence the wall is maintained under control by the annular sealing element 45 plus the closing of an appropriate conventional valve (not shown) provided at any desired point in the tubular work string, generally at the well head. Thus, the well is maintained under control irrespectively of the fact that the safety valve 1 is unable to close because of the inserted tubular work string.

Figure 3A:
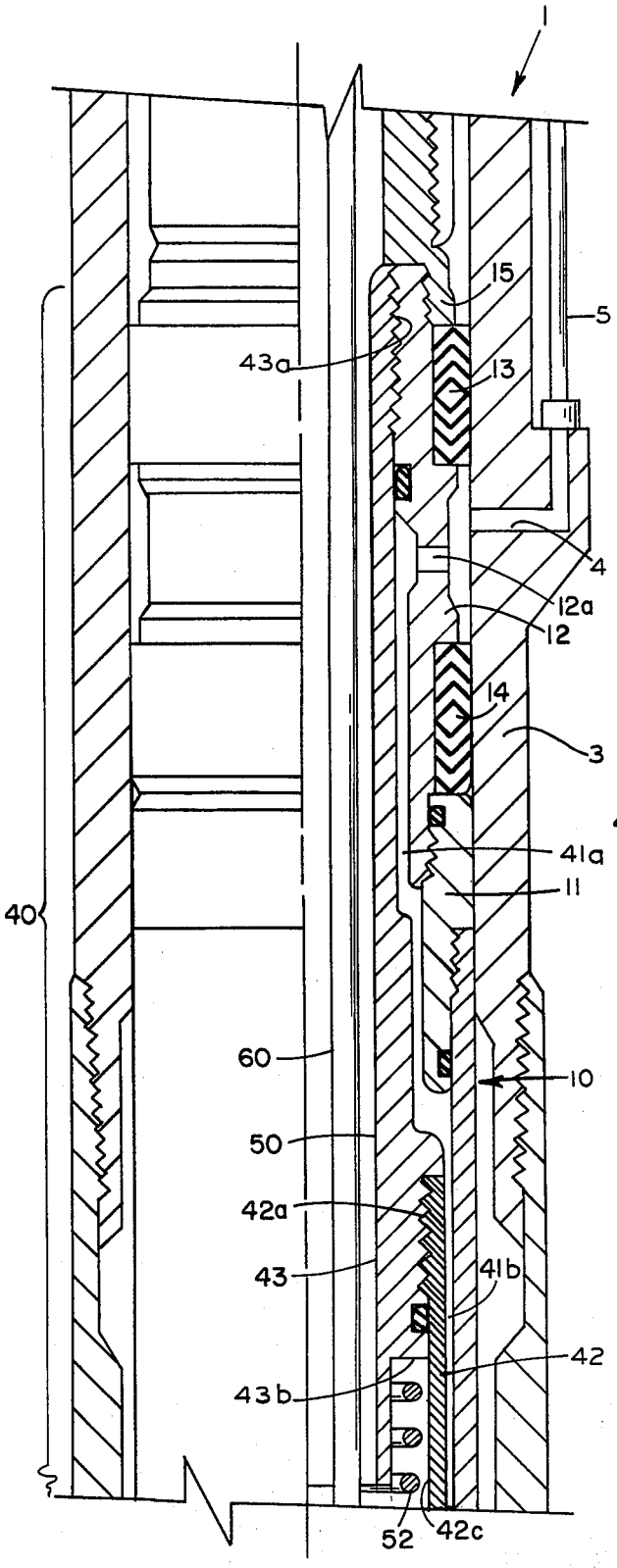
FIGS. 3A and 3B are views respectively similar to FIGS. 2A and 2B but illustrating the annulus valve in its closed or sealing position with respect to an inserted tubular work string.
Figure 3B:
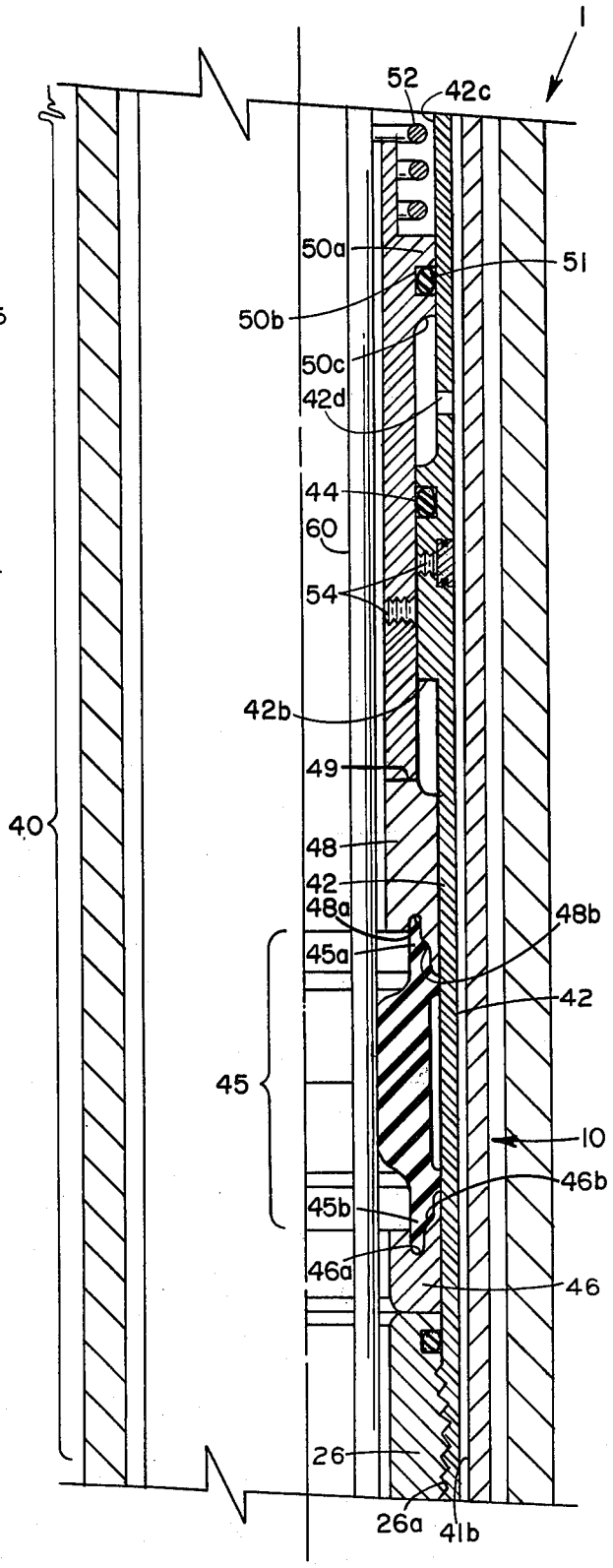

To assist the elastomeric mass 45 to readily deform in a radially inward direction, a gap indicated at 49 is provided between the bottom end of piston 50 and the top end of the anvil cam 48. This gap which, in effect, is a lost motion connection, permits the piston 50 to strike the anvil cam 48 with a sharp axial impact blow and thus transmit a similar type blow to the elastomeric seal 45. It has been found that an impact type of compressive loading of the annular elastomeric seal element 45 is much more effective in producing the desired radially inward deformation of the elastomeric material to more rapidly produce the desired seal with the exterior surface of the inserted work string 60 as illustrated in FIGS. 3A and 3B.

The annulus seal may be readily opened by restoring the control fluid pressure to the annulus apparatus 40. Such control fluid pressure will act on the piston 50 forcing it in an upward direction compressing spring 52 and relieving the compressive forces from the elastomeric seal element 45. Such seal element inherently has sufficient resilient memory to retract to approximately its original position, but certainly sufficient to clear the inserted tubular work string. The same control pressure will move safety valve piston 25 downwardly and shift ball 2 to its open position, thus permitting the tubular work string to be withdrawn from the well while the annulus valve remains in the well, ready for any subsequent use when a tubular work string is again employed.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A valve for an annulus defined between a tubular work string and a surrounding annular portion of an operative element of a production string of a subterranean well comprising: an annular valve body shiftably and sealably mountable in the bore of said annular portion for generally radial movements into and out of sealing engagement with the exterior of said tubular work string; resilient piston means urging said annular valve body into said sealing engagement; and means responsive to a control fluid pressure opposing said resilient means to permit said annular valve body to shift to its non-sealing position relative to said tubular work string upon the application of a predetermined control fluid pressure to said piston means.

2. The valve of claim 1 further comprising shearable means for retaining said annular valve body in its said non-sealing position, said shearable means being operatively connected to said piston means responsive to a control fluid pressure, whereby the application of a predetermined control fluid pressure to said piston means effects the shearing of said shearable means.

3. The valve of claim 1 wherein said annular valve body comprises an annular mass of elastomeric material, and means operatively connected to said resilient means to produce an axial compression of said annular elastomeric mass to shift the inner wall of said means into sealing engagement with the exterior of the tubular work string by the force generated by said resilient means upon reduction of said control fluid pressure.

4. The valve of claim 3 wherein said means operatively connected to said resilient means include a lost motion connection, thereby producing an axial impact force on said annular elastomeric mass.

5. The valve of claim 1 wherein said annular valve body comprises an annular mass of elastomeric material freely surrounding the tubular work string in its uncompressed condition, a first annular cam secured in the bore of said annular portion and engageable with one end of said annular elastomeric mass, a second annular cam operatively connected to said resilient means to transmit a compressive force to the other end face of said annular elastomeric mass, said first and second cam members having inclined end faces respectively contacting said end faces of the annular elastomeric mass to produce a radially inward shifting of the bore thereof into sealing engagement with the tubular work string.

6. The valve of claim 5 wherein the connection between said resilient means and said second annular cam includes a lost motion connection when said resilient means is compressed by said piston means, thereby producing an impact force on said annular elastomeric mass when the control fluid pressure is reduced.

7. The valve of claims 1, 2, 3, 4, 5, or 6 wherein the operative element of the production string comprises a valve for selective sealing across the interior of the production string.

8. In a subterranean well having a production string, the combination of: a valve incorporable in the production string and having a valve member shiftable between an open position permitting fluid flow upwardly through the production string to a closed position preventing any such upward fluid flow, said valve having an annular housing sealingly secured in the bore of the production string and mounting said valve member; fluid pressure responsive means mounted in said housing for shifting said valve member to its open position; bias means opposing the said movement of said valve member to its open position, said valve member in its open position permitting the passage therethrough of a tubular work string; an annular valve body shiftably and sealably mounted in the bore of said annular housing above said valve member for generally radial movement into and out of sealing engagement with the exterior of the tubular work string; resilient means urging said annular valve body into said sealing engagement; annular piston means responsive to a control fluid pressure opposing said resilient means to permit said annular valve body to shift to its non-sealing position relative to said tubular work string; and means for concurrently supplying the control fluid pressure to said piston means and to said fluid pressure responsive means to concurrently move said annular valve body to its non-sealing position and said valve member to its said open position, whereby the reduction of the control fluid pressure concurrently closes the valve to the extent permitted by the inserted work string and seals the annulus between the tubular work string and said annular housing.

9. The apparatus of claim 8 wherein the means for concurrently supplying the control pressure comprises a single conduit extending from the top of the well to said annular housing, and fluid passages in said housing respectively supplying control fluid from said conduit to said piston means and said fluid pressure responsive means.

10. The apparatus of claim 8 further comprising shearable means for retaining said annular valve body in its said non-sealing position, said shearable means being operatively connected to said annular piston means, whereby application of a predetermined control fluid pressure to said annular piston means effects the shearing of said shearable means.

11. The apparatus of claim 8 wherein said annular valve body comprises an annular mass of elastomeric material, and means operatively connected to said resilient means to produce an axial compression of said annular elastomeric mass to shift the inner wall of same into sealing engagement with the exterior of the tubular work string by the force generated by said resilient means upon reduction of said control fluid pressure.

12. The apparatus of claim 11 wherein said operatively connected means includes a lost motion connection, thereby producing an axial impact force on said annular elastomeric mass.

13. The apparatus of claim 8 wherein said annular valve body comprises an annular mass of elastomeric material freely surrounding the tubular work string in its uncompressed condition, a first annular cam secured in the bore of said annular portion and engageable with one end of said annular elastomeric mass, a second annular cam operatively connected to said resilient means to transmit a compressive force to the other end of said annular elastomeric mass, said first and second cam members having inclined end faces respectively contacting said end faces of the annular elastomeric mass to produce a radially inward shifting of the bore thereof into sealing engagement with the tubular work string.

14. The apparatus of claim 13 wherein the connection between said second annular cam and said resilient means includes a lost motion connection when said resilient means is compressed by said annular piston, thereby producing an impact force on said annular elastomeric mass when the control fluid pressure is reduced.

15. The apparatus of claim 8 wherein said fluid pressure responsive means is moved downwardly by the control fluid pressure and said piston means is moved upwardly.

16. A valve for an annulus defined between a tubular conduit and a surrounding annular portion of an operative element of a production string of a subterranean well comprising: an annular valve body shiftably and sealably mountable in the bore of said annular portion for generally radial movements into and out of sealing engagement with the exterior of said tubular conduit; resilient means urging said annular valve body into said sealing engagement; and means opposing said resilient means to permit said annular valve body to shift to its non-sealing position relative to said tubular conduit.

* * * * *